United States Patent [19]

Mattei et al.

[11] Patent Number: 4,738,073

[45] Date of Patent: Apr. 19, 1988

[54] DEVICE FOR FORMING AND CONTROLLING THE OUTER WRAPPING OF PACKS IN A CIGARETTE PACKAGING MACHINE

[75] Inventors: Riccardo Mattei; Allesandro Minarelli, both of Bologna, Italy

[73] Assignee: G. D. Societa per Azioni, Bologna, Italy

[21] Appl. No.: 918,889

[22] Filed: Oct. 15, 1986

[30] Foreign Application Priority Data

Oct. 23, 1985 [IT] Italy ..... 3578 A/85

[51] Int. Cl.[4] ..... B65B 57/04

[52] U.S. Cl. ..... 53/51; 53/53; 53/234; 209/536

[58] Field of Search ..... 53/51, 53, 234; 209/535, 536, 587, 548; 250/548

[56] References Cited

U.S. PATENT DOCUMENTS

| | | | |
|---|---|---|---|
| 2,603,925 | 7/1952 | Moore | 53/234 X |
| 3,141,589 | 7/1964 | Jochim | 53/51 |
| 3,762,130 | 10/1973 | Davies | 53/53 X |
| 3,899,863 | 8/1975 | Seragnoli | 53/53 |
| 3,939,984 | 2/1976 | Butner | 53/53 X |
| 3,948,115 | 4/1976 | Seragnoli | 53/234 X |
| 3,977,157 | 8/1976 | Davies | 53/234 X |
| 4,011,155 | 3/1977 | Feurstein | 53/53 X |
| 4,053,056 | 10/1977 | Day | 209/536 X |

FOREIGN PATENT DOCUMENTS

| | | | |
|---|---|---|---|
| 16984 | 7/1979 | Japan | 250/548 |
| 902834 | 8/1962 | United Kingdom | 53/51 |

*Primary Examiner*—John Sipos

*Attorney, Agent, or Firm*—Cushman, Darby & Cushman

[57] ABSTRACT

The device comprises an indexed conveyor wheel having a cylindrical surface with pockets, and a pair of photocell type transducers, one preceding the other in the direction of rotation of wheel, the first located in alignment with a station at which each pocket pauses as the wheel is indexed; one such transducer verifies the correct position of the outer wrapping in relation to the ends of the pack, whilst the other verifies correct position of the wrapping in relation to the sides. A knock-out interlocked to the transducers enables automatic rejection of those packs exhibiting defects in positioning of the outer wrapping.

5 Claims, 2 Drawing Sheets

FIG. 1
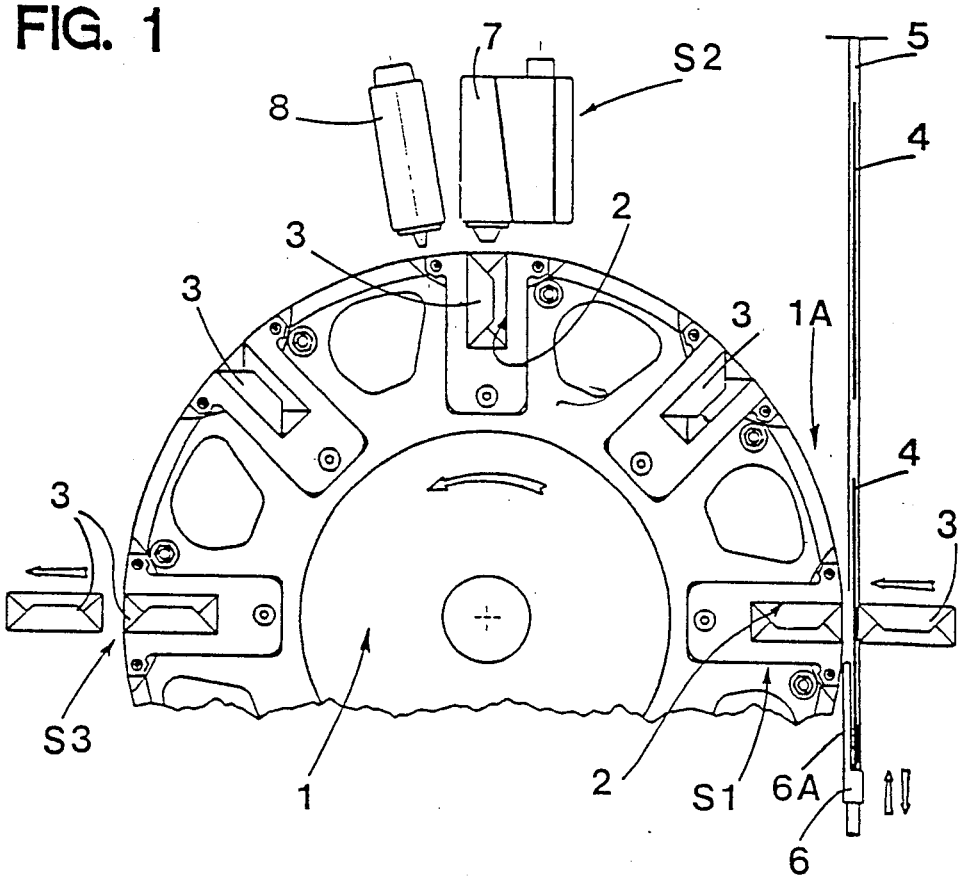
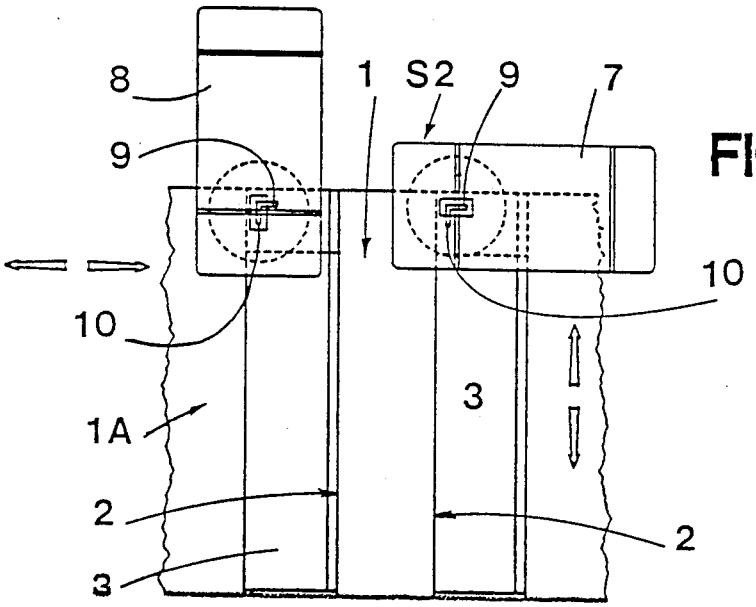
FIG. 3

DEVICE FOR FORMING AND CONTROLLING THE OUTER WRAPPING OF PACKS IN A CIGARETTE PACKAGING MACHINE

BACKGROUND of the INVENTION

The invention relates to a device for forming and controlling the outer wrapping of packs turned out by a cigarette packaging machine, and in particular, to a device capable of verifying the correct position of the outer wrapping, i.e. the label, of crush, or American style packs of cigarettes.

The prior art embraces a cigarette packaging machine disclosed in U.S. Pat. No. 3,948,115 in the name of the same applicant, in which substantially parallelepiped packs, consisting of a stack of cigarettes enveloped in foil, are introduced singly together with a sheet of wrapping material (the label) into the radial pockets of an indexing cylindrical conveyor wheel. The labels are formed from rectangular sheets of paper exhibiting printed matter, and are designed to cover the front, back and sides of the pack and one of its two ends, thereby constituting the outer wrapping of the crush type pack.

The label sheets are supplied singly through a vertical path, substantially at a tangent to the cylindrical surface of the conveyor wheel, in such a way that each folds about a respective pack into a "U" profile when slotted into the radial pocket offered by the wheel.

Once taken up by the wheel, the two endmost strips of the label which project outward from the pocket are flattened against one side of the pack by fixed and moving folder mechanisms. Thus, the label is made to ensheath the pack carried internally of the wheel, with its two ends overlapping along one side of the parallelepiped, namely, that facing outward from the pocket.

Notwithstanding the inclusion of means for guiding and adjusting the label sheets during their passage down the vertical supply path, and of an end stop, it can happen that a sheet will not be correctly aligned with the pack at the moment of their being slotted into a pocket of the conveyor wheel. More precisely, the sheet may not be positioned with its axis exactly vertical, or may not have located against the end stop, at the moment when the pack is brought to bear.

Such defects in adjustment of the sheet, in relation to the pack, may be of an order that will occasion jamming during subsequent packaging operations, due to unwarranted creasing, or tearing of the label. In these instances, the defective packs will be removed either manually or automatically.

Where defects in adjustment of the label are of a minor order, that is, not such as will cause a jam, but sufficient to compromise appearance, the defective packs will be removed only in the event of their being singled out by the operator; examples of such minor defects would be a pack in which the overlapping label ends are not exactly parallel with the adjacent edges of the pack itself, or a pack enveloped by a label exhibiting less than perfect alignment of its printed matter in relation to the face of the pack on which it appears.

The object of the invention is that of providing a device for forming the outer wrapping of crush type cigarette packs, in which any defect in adjustment of the label is detected automatically in order to enable automatic rejection of sub-standard packs.

SUMMARY of the INVENTION

The stated object is realized according to the invention described herein, which relates to a device for forming and for controlling the position of the outer wrapping of packs turned out by a cigarette packaging machine.

Such a device comprises a conveyor provided with pockets, each designed to accomodate a pack slotted thereinto together with a sheet of material designed to constitute the outer wrapping of the pack, and indexed from an entry station at which the packs and the sheets are admitted, to an exit station from which the packs emerge, ensheathed by the sheets. An essential feature of the device is that it comprises means, located along the path followed by the conveyor, for detecting the position of the wrapping in relation to the pack, and ejector means interlocked to the detection means.

BRIEF DESCRIPTION of the DRAWINGS

The invention will now be described in detail, by way of example, with the aid of the accompanying drawings, in which:

FIG. 1 is the frontal view of a device according to the invention;

FIG. 3 is a detail of FIG. 1 in enlarged scale, which illustrates how the detection means are arranged so as to permit of verifying the correct position of the outer wrapping of a pack during its formation;

DESCRIPTION of the PREFERRED EMBODIMENT

Figure 2:
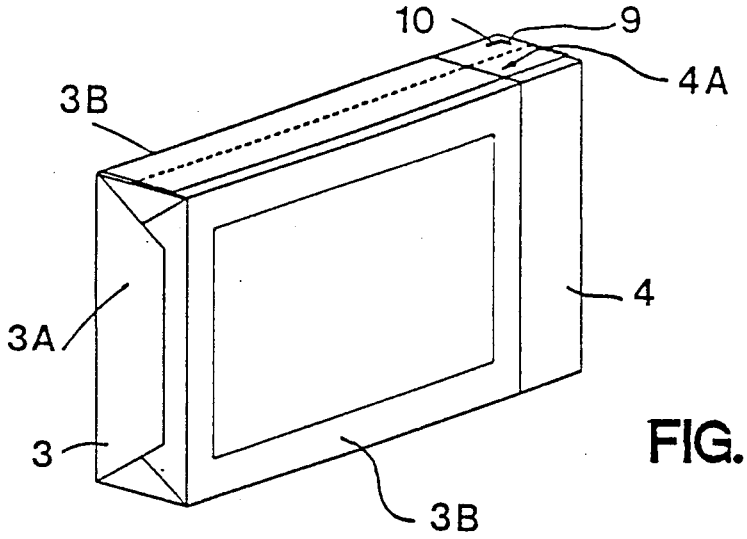
FIG. 2 is the schematic illustration of a pack as it appears on arrival at the control station alongside which the detection means are located.

With reference to FIG. 1 of the drawings, 1 denotes an indexing conveyor wheel, in its entirety, which turns anticlockwise through 45° at each intermittent step. The wheel rotates about a horizontal axis, and is provided with eight radially-disposed peripheral pockets 2 set apart at 45° one from the next.

Each radial pocket 2 is designed to accommodate a parallelepiped having the dimensions of a pack 3 of cigarettes; the open side of the pocket 2 coincides with the cylindrical surface 1A of the wheel 1, and its two open longitudinal ends coincide with the two side faces of the wheel 1.

Sheets 4 of printed paper, or labels, constitute the outer wrapping of the packs of cigarettes, and are supplied through a vertical path, substantially at a tangent to the cylindrical surface 1A of the wheel. The label sheets 4 are severed from a roll (not illustrated) by suitable cutting components stroking in rapid succession and in time with the indexed movement of the conveyor wheel 1. The single sheet 4 runs down between guides 5 toward a stable position beside an entry station S1 via which the packs 3 are admitted to the wheel 1.

The station S1 incorporates a stop 6, which in a first position enables a label sheet 4 to draw alongside the pocket 2; in a second stage, an integral part 6A of the stop 6 functions as a folder, serving to flatten the projecting end of the sheet 4 against the pack 3 slotted into the radial pocket 2 occupying the station S1.

7 and 8 denote detection means consisting in first and second transducers respectively. The first such transducer 7 is positioned in alignment with a station S2 at which each pocket 2 pauses in the course of the indexed rotation of the conveyor wheel 1 that takes packs 3 from the entry station S1 round to an exit station S3. Ensheathed by its outer wrapping, or label sheet 4, the single pack 3 advances from the exit station S3 toward further manufacturing and/or control operations.

The transducers 7 and 8 are mounted to the bearing structure of the machine (not illustrated in the drawings) and directed at the cylindrical surface 1A of the conveyor wheel 1; it will be observed from FIG. 1 that their position, riding one of the edges of the cylindrical surface 1A, is such as to permit detection of a pair of reference marks 9 and 10 provided on the sheet 4 passing beneath.

The transducers 7 and 8 might be embodied as miniaturized reflected-beam photocells comprising a light-emitting component (e.g. a LED) and a photosensitive receiver, for example a phototransistor.

The first transducer 7 is positioned trained toward the radial pocket 2 currently occupying the control station S2 in such a way as to enable scrutiny of the endmost strip 4A of the sheet 4 (FIG. 2) and detect the first reference mark 9.

The second transducer 8 occupies an angular position slightly retarded from the first 7, in relation to the control station S2, such as enables scrutiny of the endmost strip 4A of the sheet 4 and detection of the second reference mark 10.

The first reference mark 9 runs parallel to one end 3A of the pack (see FIG. 2) and, in breaking the beam of the first transducer 7, verifies the position of the label sheet 4 as being correct in relation to that end 3A. The second mark 10 runs parallel to the edges of the front, back and side faces of the pack and, in breaking the beam of the transducer 8, verifies correct positioning of the sheet in relation to those faces of the pack 3, for example in relation to the front or back 3B, with which printed matter exhibited by the label sheet 4 must be aligned.

Figure 4:
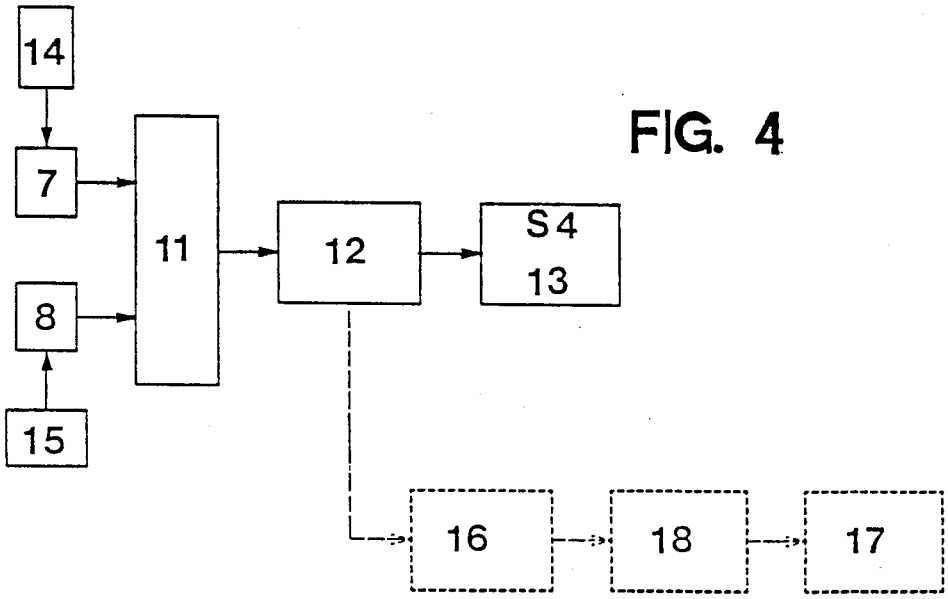
FIG. 4 is the block diagram of an electrical circuit controlling ejector means which are interlocked to the detection means and serve to knock out defective packs.

In the example of FIG. 4, the transducers 7 and 8 are integrated into an electrical circuit comprising a reader 11 capable of analyzing their output signals. In the event of at least one of the marks 9 and 10 failing to break the relative beam, the reader 11 will supply a signal to a delay buffer 12 the function of which is to count the number of indexed movements of the wheel 1 (corresponding in number to the steps through which packs 3 are advanced along the line from the exit station S3) required to bring the defective pack 3 into a knock-out station S4 (see FIG. 4). A control signal, relayed to the knock-out station by the selfsame buffer 12, will then trigger operation of an ejector 13 so as to eliminate the sub-standard pack.

The transducers 7 and 8 could be interlocked to actuators, 14 and 15 respectively, operated directly by a timed shaft of the packaging machine into which the device is incorporated. The actuators 14 and 15 will impinge on the transducers 7 and 8 in such a way that operation of the first 7 occurs when the radial pocket 2 occupies the station S2, and operation of the second 8 occurs once the wheel has been set in motion and taken the pocket 2 through an angular distance sufficient for its beam to be broken by the second mark 10.

In an alternative embodiment, illustrated by the broken line of FIG. 4, the buffer 12 is wired to an electrical circuit operating a device 16 integrated into the packaging machine, down-line of the device disclosed, for the purpose of applying a government stamp or other such seal. In this instance, the buffer 12 will inhibit operation of the device 16 upon detection of a defective pack, and the pack in question will be knocked out ultimately by an ejector 17 triggered by a conventional transducer 18 serving to verify existence and correct positioning of the stamp.

Operation of the device will now be described in brief, following a pack 3 from arrival at the entry station S1 to departure from the exit station S3.

With the conveyor wheel 1 at standstill, a pack 3 slotted into the pocket 2 occupying the station S1 impinges on a sheet 4, forcing it to fold into "U" shape. The stop 6 moves upward, flattening one of the endmost strips 4A of the sheet 4 projecting from the pocket 2 against the outermost side of the enveloped pack 3.

The wheel 1 now indexes in the direction of the arrow F (see FIG. 1), the stop 6 returns to its former position, and fixed folder components (not illustrated) proceed to flatten the remaining strip 4A of the projecting sheet 4 against the outermost side of the pack 3. Two indexed steps of the wheel 1 will bring the pack 3 in question around to the control station S2 in the condition shown in FIG. 2, i.e. with the label sheet 4 ensheathing the pack 3 and overlapping along the side directed away from the cylindrical surface 1A.

With the pack 3 occupying the station S2, the first actuator 14 enables operation of the first transducer 7. As long as the mark 9 breaks the beam of the transducer 7, there will be no signal relayed to the reader 11; should no break occur, the reader 11 will receive a signal to activate the buffer 12, and the defective pack 3 will be knocked out of the packaging line automatically by the ejector 13 on arrival at the relative station S4.

In the alternative embodiment aforementioned, activation of the buffer 12 by a defective pack results in the relay of an inhibiting signal to the device denoted 16, and application of the stamp to the defective pack 3 is disallowed; the stamp verification transducer 18 and the ejector 17 will then provide for automatic knock-out of the defective pack 3.

With the wheel 1 in motion, passage of the pack 3 beneath the second transducer 8 produces practically the same operating steps as already described for the first transducer 7. Any signal relayed by the second transducer 8 may be ignored by the reader 11, if already activated by a signal from the first transducer 7; in either case, the buffer 12 will be set, and commence counting the number of steps indexed between the control station S2 and the knock-out station 13 or 17.

The ultimate positioning of the transducers 7 and 8, and their operating time lapse, depend substantially upon the dimensions of the pack 3, the position of the reference marks 9 and 10 on the label sheet 4, and the characteristics of the beam from the light-emitting component of the transducers 7 and 8 themselves. In the event that the three parameters permit, the two transducers 7 and 8 might both operate at the station S2 during the pause between indexed movements of the wheel 1, in other words, functioning as a single means of detection comprising two miniaturized transducers 7 and 8 capable of effecting the readings described above.

Lastly, it will be noted that the reference marks 9 and 10 will not be visible on completion of the wrapping operations, located as they are on a part of the sheet 4 that will ultimately be concealed in the final packaging stages when that end of the pack is folded.

What is claimed:

1. A device for forming and for controlling the position of the outer wrapping of packs in a cigarette packaging machine, comprising a conveyor provided with pockets, each pocket designed to accommodate a pack slotted thereinto together with a sheet of material designed to constitute the outer wrapping of the pack, and indexed from an entry station at which the packs and the sheets are admitted, to an exit station from which the packs emerge ensheathed by the sheets: means, located along the path followed by the conveyor, for detecting the position of the wrapping in relation to the pack; and ejector means interlocked to the detection means wherein the detection means include a first transducer that verifies the position of the outer wrapping through a direction parallel to the conveyor, and a second transducer that verifies the position of the outer wrapping through a direction transverse to the conveyor, said first and second transducers being positioned in relation to the conveyor, one at a point where the pocket remains stationary, and the other at a point through which the pocket is indexed, said transducers being designed to interact with marks provided at one end of the outer wrapping in verifying the correct position of the wrapping in directions parallel and transverse to the conveyor.

2. A device as in claim 1, wherein the first and second transducers are positioned such that their respective control functions are implemented during one indexed step of the conveyor wheel.

3. A device as in claim 1, wherein the detection means are activated synchronously with the indexed movement of the conveyor wheel by actuator means interlocked to a timed shaft of the packaging machine.

4. A device as in claim 1 wherein the conveyor includes a rotatable wheel and wherein the pockets are located along the periphery of the wheel, the pockets having open sides which coincide with the cylindrical surface of the wheel.

5. In a cigarette packaging machine for wrapping a sheet about each of a plurality of packs comprising: a rotatable conveyor wheel having radially outwardly facing pockets arranged along its periphery, said wheel being rotatable about its axis so that each pocket can be moved along a path and indexed at an entry station and at an exit station; means located at the entry station for introducing a pack and a wrapping sheet into a pocket in said wheel; means located at the exit station for ejecting a wrapped pack from a pocket in said wheel; detector means located along the path followed by a pocket for detecting the position of a wrapping on a pack, said detector means including a first transducer responsive to a first reference mark on each wrapped sheet for verifying the position of the wrapped sheet relative to the respective pack along a direction parallel to the axis of the wheel and a second transducer responsive to a second reference mark on each wrapped sheet for verifying the position of the wrapped sheet relative to the respective pack along a direction transverse to the axis of the wheel; and ejector means responsive to said detector means for ejecting an unwanted pack and its wrapping from a pocket.

* * * * *